US010054089B2

(12) United States Patent
Takahashi et al.

(10) Patent No.: US 10,054,089 B2
(45) Date of Patent: Aug. 21, 2018

(54) FUEL SUPPLY DEVICE

(71) Applicants: DENSO CORPORATION, Kariya, Aichi-pref. (JP); KYOSAN DENKI CO., LTD., Koga, Ibaraki-pref. (JP)

(72) Inventors: Hideto Takahashi, Kariya (JP); Masaharu Oohashi, Kariya (JP); Tetsuro Okazono, Kariya (JP); Hironobu Oki, Koga (JP)

(73) Assignees: DENSO CORPORATION, Kariya (JP); KYOSAN DENKI CO., LTD., Koga (JP)

( * ) Notice: Subject to any disclaimer, the term of this patent is extended or adjusted under 35 U.S.C. 154(b) by 0 days.

(21) Appl. No.: 15/523,776

(22) PCT Filed: Nov. 2, 2015

(86) PCT No.: PCT/JP2015/005506

§ 371 (c)(1),
(2) Date: May 2, 2017

(87) PCT Pub. No.: WO2016/072086

PCT Pub. Date: May 12, 2016

(65) Prior Publication Data

US 2017/0314522 A1 Nov. 2, 2017

(30) Foreign Application Priority Data

Nov. 6, 2014 (JP) ..... 2014-226226

(51) Int. Cl.
*F02M 37/04* (2006.01)
*F02M 37/10* (2006.01)
*F02M 55/04* (2006.01)

(52) U.S. Cl.
CPC ..... *F02M 37/106* (2013.01); *F02M 55/04* (2013.01)

(58) Field of Classification Search
CPC .. F02M 37/103; F02M 37/106; F02M 37/025; F02M 55/04
(Continued)

(56) References Cited

U.S. PATENT DOCUMENTS 5,769,061 A * 6/1998 Nagata ..... B01D 35/26 123/509
6,098,600 A * 8/2000 Umetsu ..... F02M 37/106 123/514
(Continued)

FOREIGN PATENT DOCUMENTS

| | | |
|---|---|---|
| DE | 102012200588 | 7/2013 |
| DE | 102012200590 | 7/2013 |
| JP | 2007-231764 | 9/2007 |

OTHER PUBLICATIONS

U.S. Appl. No. 15/506,041, Takashi et al., filed Feb. 23, 2017, 38 pages.

*Primary Examiner* — Hai Huynh
(74) *Attorney, Agent, or Firm* — Nixon & Vanderhye PC

(57) ABSTRACT

A fuel supply device includes a sub-tank, a pump unit, a jet pump, and a connection structure connected with the pump unit and the jet pump. The connection structure has a guide part that is provided to the pump unit and guides the pressurized fuel toward the bottom in an axial direction, a pressurizing part that is provided to the jet pump and is fitted to the guide part from a side of the bottom in an axially slidable manner, to which the pressurized fuel is guided from the guide part, a shock-absorbing member that has a low spring constant that is predetermined and mitigates an axial impact between the guide part and the pressurizing part, and a sealing member that has a high spring constant higher than the low spring constant of the shock-absorbing member and radially seals a space between the guide part and the pressurizing part.

7 Claims, 13 Drawing Sheets

(58) Field of Classification Search
USPC ..... 123/509
See application file for complete search history.

(56) References Cited

U.S. PATENT DOCUMENTS

| | | | | |
|---|---|---|---|---|
| 6,260,543 | B1 | 7/2001 | Chih | |
| 6,439,205 | B2 * | 8/2002 | Ushigome | F02M 37/106 123/509 |
| 6,513,503 | B2 * | 2/2003 | Iwamoto | F02M 37/025 123/509 |
| 6,964,264 | B2 * | 11/2005 | Yoshioka | B01D 35/027 123/509 |
| 7,765,990 | B2 | 8/2010 | Braun et al. | |
| 9,850,865 | B2 * | 12/2017 | Hayashi | F02M 37/025 |
| 2002/0014225 | A1 | 2/2002 | Ushigome | |
| 2011/0000468 | A1 | 1/2011 | Malec et al. | |
| 2013/0306168 | A1 | 11/2013 | Braun et al. | |
| 2014/0053814 | A1 | 2/2014 | Fisher et al. | |
| 2016/0252060 | A1 | 9/2016 | Niwa et al. | |
| 2016/0265494 | A1 * | 9/2016 | Niwa | F02M 37/22 |

* cited by examiner

FUEL SUPPLY DEVICE

CROSS REFERENCE TO RELATED APPLICATION

This application is the U.S. national phase of International Application No. PCT/JP2015/005506 filed on Nov. 2, 2015 which designated the U.S. and claims priority to Japanese Patent Application No. 2014-226226 filed on Nov. 6, 2014, the disclosure of each of which are incorporated herein by reference.

TECHNICAL FIELD

The present disclosure relates to a fuel supply device which supplies fuel in a fuel tank to an internal combustion engine outside the fuel tank in a vehicle.

BACKGROUND ART

A fuel supply device in the related art has a pump unit which is housed in a sub-tank held inside a fuel tank and the pump unit pressurizes fuel stored in the sub-tank and discharges pressurized fuel to an internal combustion engine.

Patent Literature 1 discloses a type of the fuel supply device as above, in which a jet pump is installed on a bottom of a sub-tank to pump fuel stored in a fuel tank into the sub-tank by jetting pressurized fuel guided from a pump unit.

PRIOR ART LITERATURES

Patent Literature

Patent Literature 1: U.S. Pat. No. 7,765,990

SUMMARY OF INVENTION

In the fuel supply device disclosed in Patent Literature 1, however, the pump unit and the jet pump are fixed so tightly that when an impact of relatively large amplitude is made to the jet pump installed on the bottom of the sub-tank while a vehicle is moving, the pump unit directly receives the impact and may possibly fail to operate properly. In addition, when vibrations of relatively small amplitude generated in association with a fuel supply operation of the pump unit propagate directly to the jet pump installed on the bottom of the sub-tank, the fuel tank holding the sub-tank and further components forming the vehicle may vibrate and generate noise.

The present disclosure has an object to provide a fuel supply device restricting an occurrence of a failure and generation of noise.

According to a first aspect of the present disclosure, the fuel supply device which supplies a fuel in a fuel tank to an internal combustion engine outside the fuel tank in a vehicle includes a sub-tank held inside the fuel tank, a pump unit housed in the sub-tank and discharging the fuel stored in the sub-tank to the internal combustion engine by pressurizing the fuel, a jet pump installed on a bottom of the sub-tank to pump the fuel stored in the fuel tank into the sub-tank by jetting a pressurized fuel guided from the pump unit, and a connection structure connected with the pump unit and the jet pump. The connection structure has a guide part that is a cylindrical shape, is provided to the pump unit, and guides the pressurized fuel toward the bottom in an axial direction, a pressurizing part that is a cylindrical shape, is provided to the jet pump, and is fitted to the guide part from a side of the bottom in an axially slidable manner, to which the pressurized fuel is guided from the guide part, a shock-absorbing member that has a low spring constant that is predetermined and mitigates an axial impact between the guide part and the pressurizing part, and a sealing member that has a high spring constant higher than the low spring constant of the shock-absorbing member and radially seals a space between the guide part and the pressurizing part.

In the connection structure connected with the pump unit and the jet pump in the fuel supply device, the pressurizing part of the jet pump is fitted to the guide part of the pump unit in an axially slidable manner from the side of the bottom of the sub-tank. Owing to such a fitting configuration of the guide part and the pressurizing part, the shock-absorbing member having the low spring constant mitigates an axial impact between the guide part and the pressurizing part. Hence, even when an impact of relatively large amplitude is made to the jet pump installed on the bottom of the sub-tank while the vehicle is moving, the impact which has propagated from the side of the bottom of the sub-tank to the pressurizing part can be mitigated by the shock-absorbing member having the low spring constant. Consequently, because the pump unit hardly receives an external impact directly, an occurrence of a failure can be restricted.

According to the fuel supply device, owing to the fitting configuration of the guide part and the pressurizing part as above, the sealing member having the high spring constant higher than the low spring constant of the shock-absorbing member radially seals a space between the guide part and the pressurizing part. Accordingly, by using the sealing member having the high spring constant and capable of limiting fuel leakage in a guide path from the guide part toward the pressurizing part, vibrations of relatively small amplitude generated in association with a fuel supplying operation of the pump unit can be attenuated between the guide part and the pressurizing part. Hence, because vibrations from the pump unit hardly propagate directly to the jet pump installed on the bottom of the sub-tank, generation of noise due to vibrations of the fuel tank holding the sub-tank and further vibrations of components forming the vehicle can be restricted.

According to a second aspect of the present disclosure, the pressurizing part is inserted in the guide part on an inner peripheral side, and the pressurizing part is provided with a shoulder surface stopping the seal member between the pressurizing part and the guide part from the side of the bottom in the axial direction.

According to the first embodiment, the pressurizing part is inserted in the guide part on the inner peripheral side and the sealing member between the pressurizing part and the guide part is stopped by the shoulder surface of the pressurizing part from the side of the bottom of the sub-tank in the axial direction. The sealing member between the guide part and the pressurizing part is thus capable of exerting not only the sealing function but also a vibration attenuation function in a stable manner. Consequently, reliability of a noise generation restricting effect can be increased. Moreover, because the sealing member exerts the sealing function on pressurized fuel which has entered the space between the guide part and the pressurizing part on the inner peripheral side of the guide part, the shoulder surface is pressed against the bottom of the sub-tank by the pressurized fuel via the sealing member. Consequently, because the jet pump can be positioned while being pressed against the bottom of the sub-tank, reliability of a fuel pumping function can be increased.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Figure 1:
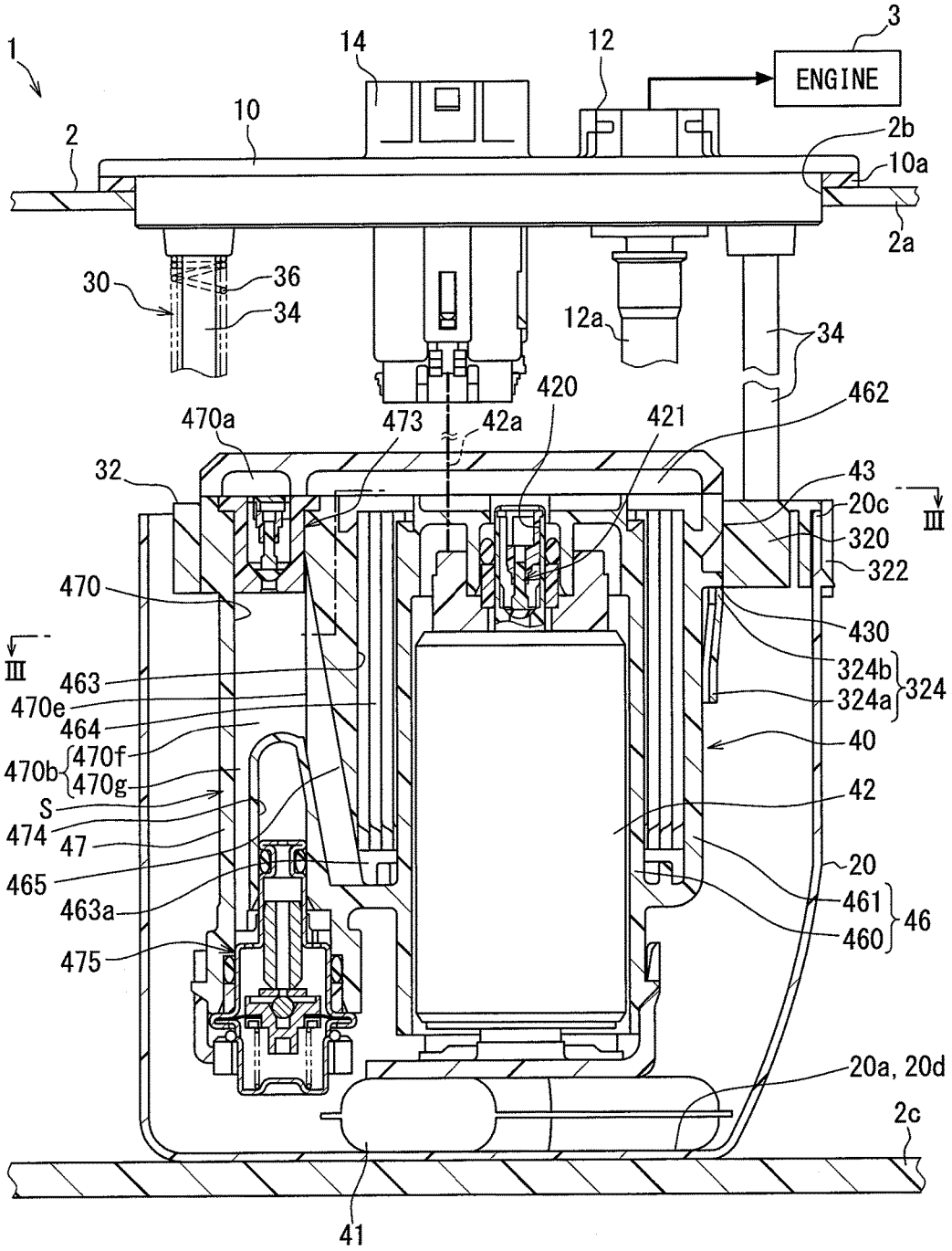
FIG. 1 is a cross section of a fuel supply device of a first embodiment taken along the line I-I of FIG. 3.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Figure 2:
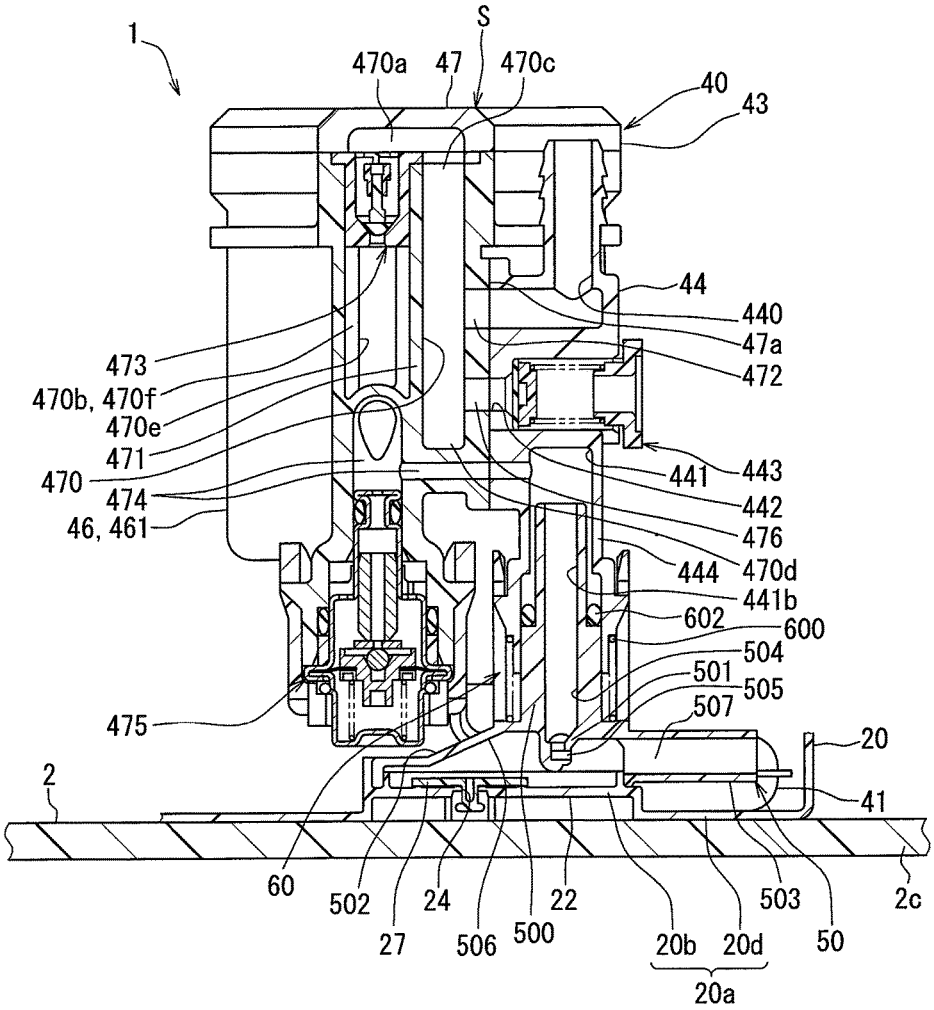
FIG. 2 is a cross section taken along the line II-II of FIG. 3.

As are shown in FIGS. 1 and 2, a fuel supply device 1 according to a first embodiment of the present disclosure is installed to a fuel tank 2 in a vehicle. The fuel supply device 1 supplies fuel in the fuel tank 2 to fuel injection valves of an internal combustion engine 3 either directly or indirectly via a high-pressure pump or the like. The fuel tank 2, to which the fuel supply device 1 is installed, is made of resin or metal and formed in a hollow shape to store fuel to be supplied to the internal combustion engine 3. The internal combustion engine 3 supplied with fuel from the fuel supply device 1 may be a gasoline engine or a diesel engine. A top-bottom direction of the fuel supply device 1 shown in FIGS. 1 and 2 substantially coincides with a top-bottom direction of the vehicle on a level plane.

Hereinafter, a configuration and an operation of the fuel supply device 1 will be described.

As are shown in FIGS. 1 to 4, the fuel supply device 1 includes a flange 10, a sub-tank 20, an adjustment mechanism 30, a pump unit 40, and a jet pump 50.

As is shown in FIG. 1, the flange 10 made of resin is formed in a shape of a circular plate and attached to a top board part 2*a* of the fuel tank 2. The flange 10 closes a through-hole 2*b* provided to the top board part 2*a* by sandwiching a packing 10*a* between the self and the top board part 2*a*. The flange 10 integrally has a fuel supply tube 12 and an electrical connector 14.

The fuel supply tube 12 protrudes both upward and downward from the flange 10. The fuel supply tube 12 communicates with the pump unit 40 via a flexible tube 12*a* that is bendable. The fuel supply tube 12 having such a communication configuration supplies fuel press-fed from inside the fuel tank 2 by a fuel pump 42 of the pump unit 40 to the internal combustion engine 3 outside the fuel tank 2. The electrical connector 14 also protrudes both upward and downward from the flange 10. The electrical connector 14 connects the fuel pump 42 to an external control circuit (not shown). Owing to such an electrical connection configuration, the fuel pump 42 is controlled by the control circuit.

Figure 4:
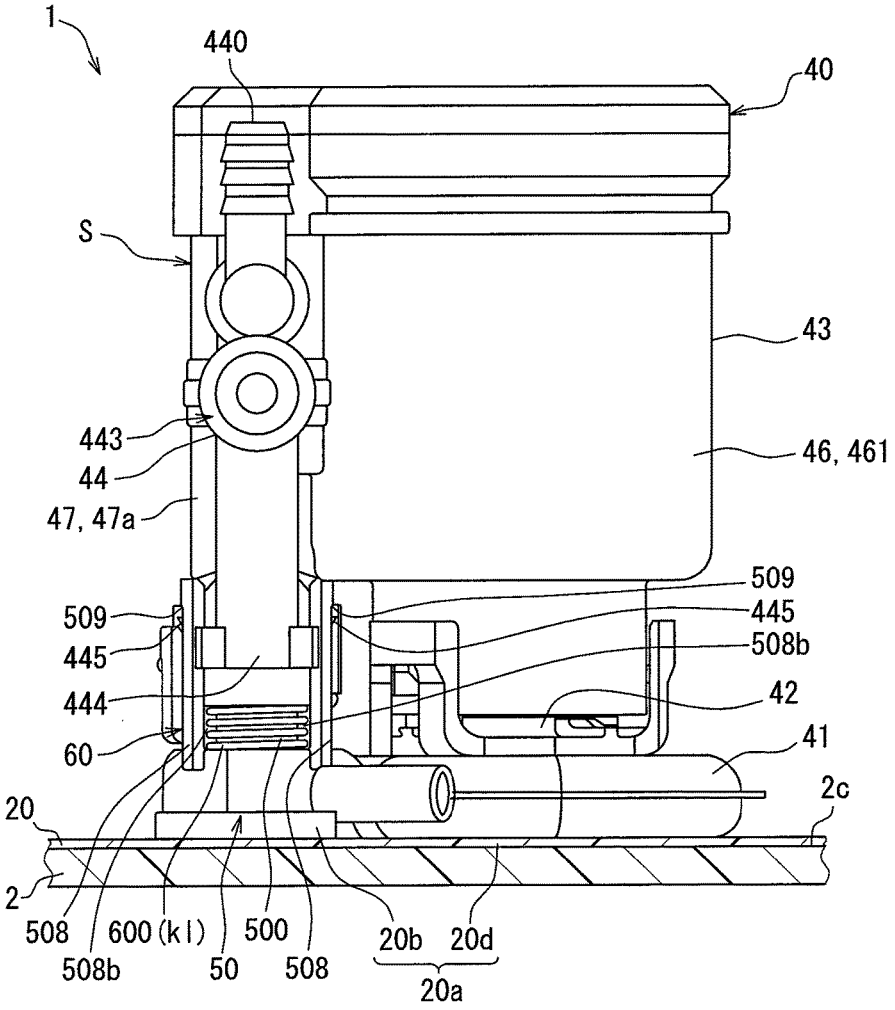
FIG. 4 is a partial cross section of the fuel supply device of FIG. 1.

As are shown in FIGS. 1, 2, and 4, the sub-tank 20 made of resin is formed in a shape of a circular bottomed-cylinder and held inside the fuel tank 2. A bottom 20*a* of the sub-tank 20 is provided on a bottom 2*c* of the fuel tank 2. As is shown in FIG. 2, the bottom 20*a* has a recessed bottom 20*b* which is dented upward and thereby secures an inflow space 22 between the bottom 20*a* and the bottom 2*c*. Further, the recessed bottom 20*b* is provided with an inflow port 24. The inflow port 24 communicates with an interior of the fuel tank 2 via the inflow space 22. The inflow port 24 having such a communication configuration lets a fuel in the pump unit 40 that is pumped from the fuel tank 2 by the jet pump 50 flow into the sub-tank 20. The fuel let in from the inflow port 24 is stored in the sub-tank 20. An umbrella valve 27 is provided on the recessed bottom 20*b* of the present embodiment to open the inflow port 24 under an action of a negative pressure from the jet pump 50 described below in detail.

As is shown in FIG. 1, the adjustment mechanism 30 includes a holding member 32, a pair of supporting columns 34, an adjustment spring 36, and so on, and is housed in the fuel tank 2.

The holding member 32 is made of resin and provided from inside to outside of the sub-tank 20. The holding member 32 includes a main body part 320 of an annular plate shape to which multiple attachment parts 322 and multiple elastic parts 324 are attached in a peripheral direction of the main body part 320. Each attachment part 322 is attached to a top part 20*c* of the sub-tank 20. Each elastic part 324 is formed in a shape of an arc plate and a lower end 324*a* is supported on the main body part 320. The elastic part 324 is thus elastically deformable in a radial direction of the sub-tank 20.

Each supporting column 34 made of metal is formed in a circular cylindrical shape and extends in the top-bottom direction between the flange 10 and the sub-tank 20. An upper end of each supporting column 34 is fixed to the flange 10. Each supporting column 34 is slidably supported on the holding member 32 or the sub-tank 20 in the top-bottom direction on a lower side of the upper end. The adjustment spring 36 made of metal is formed in a coil spring shape and provided coaxially with one of the supporting columns 34 on an outer peripheral side. The adjustment spring 36 is interposed between the one supporting column 34 and the sub-tank 20 in the top-bottom direction. The adjustment spring 36 having such an interposing configuration keeps pressing the bottom 20*a* of the sub-tank 20 against the bottom 2*c* of the fuel tank 2.

As are shown in FIGS. 1 to 4, the pump unit 40 includes a suction filter 41, the fuel pump 42, a filter case 43, a port member 44, and so on, and is housed in the fuel tank 2.

As are shown in FIGS. 1, 2, and 4, the suction filter 41 is, for example, a non-woven cloth filter and provided inside the sub-tank 20. The suction filter 41 is provided on a deepest bottom 20*d* surrounding an outer periphery of the recessed bottom 20*b* in the bottom 20*a* of the sub-tank 20. The suction filter 41 removes large foreign matter from fuel to be drawn into the fuel pump 42 from inside the sub-tank 20 by filtering the fuel to be drawn.

The fuel pump 42 is an electrical pump of a circular cylindrical shape as a whole and provided inside the sub-tank 20. The fuel pump 42 is connected with the suction filter 41 below with an axial direction aligned in the top-bottom direction. As is shown in FIG. 1, the fuel pump 42 is connected with the electrical connector 14 via a flexible wire 42*a* that is bendable. The fuel pump 42 operates under driving control of the control circuit via the electrical connector 14. The fuel pump 42 in operation draws in fuel stored in the sub-tank 20 through the suction filter 41 and regulates a pressure of the drawn fuel according to a degree of pressurization in the interior.

The fuel pump 42 has a feed valve 421 integrally with a feed port 420 from which fuel is fed. The feed valve 421 is a springless check valve and opens while fuel is pressurized in association with an operation of the fuel pump 42. While the feed valve 421 is open, fuel is press-fed into the filter case 43 from the feed port 420. Meanwhile, the feed valve 421 closes when pressurization of fuel is stopped because the fuel pump 42 stops. While the feed valve 421 is closed, press-feeding of fuel into the filter case 43 is stopped. A pressure of pressurized fuel discharged from the fuel pump 42 is adjustable in a range, for example, from 300 kPa to 600 kPa.

As is shown in FIG. 1, the filter case 43 made of resin is formed in a hollow shape and provided from inside to outside of the sub-tank 20. A stepped surface 430 provided to an upper part of the filter case 43 to face downward is stopped by an upper end 324*b* of each elastic part 324 which is an elastically deformable part of the holding member 32 attached to the top part 20*c* of the sub-tank 20. Owing to such a stopping configuration, the top part 20*c* of the sub-tank 20 elastically supports the pump unit 40 from a side of the bottom 20*a* in an axial direction via the holding member 32.

A storage part 46 of the filter case 43 is provided in a form of a double cylinder including an inner cylinder part 460 and an outer cylinder part 461 and positioned coaxially with the fuel pump 42 on an outer peripheral side. Owing to such an installation configuration of the storage part 46, an axial direction of the filter case 43 is aligned in the top-bottom direction. The storage part 46 defines a communication chamber 462 which is a flat space and communicates with the feed port 420 on an upper side of the inner cylinder part 460 and the outer cylinder part 461.

The storage part 46 also defines a storage chamber 463 which is a circular cylindrical space and communicates with the communication chamber 462 between the inner cylinder part 460 and the outer cylinder part 461. A fuel filter 464 that is a cylindrical shape is stored in the storage chamber 463. The fuel filter 464 is, for example, a honeycomb filter and removes fine foreign matter from pressurized fuel fed from the feed port 420 to the storage chamber 463 via the communication chamber 462 by filtering the pressurized fuel.

The storage part 46 further defines a relay passage 465 which is substantially a rectangular hole inclined with respect to the top-bottom direction and communicates with the storage chamber 463. The relay passage 465 communicates with a fuel outlet 463*a* of the storage chamber 463 opening on a lower side of the fuel filter 464. Owing to such a communication configuration, the relay passage 465 guides fuel filtered by the fuel filter 464 and introduced from the fuel outlet 463*a* to flow diagonally upward.

Figure 3:
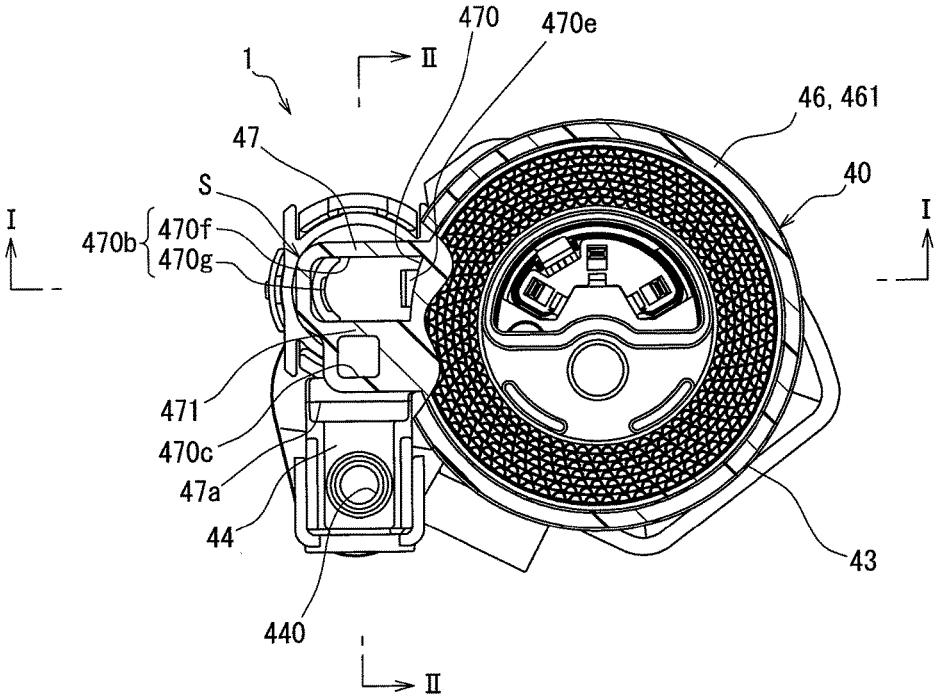
FIG. 3 is a cross section taken along the line of FIG. 1.

As are shown in FIGS. 1 to 3, the filter case 43 has a protrusion part 47 radially protruding from the outer cylinder part 461 toward a particular point S in a peripheral direction of the outer cylinder part 461. A fuel passage 470, a partition wall 471, a discharge passage 472, an external remaining pressure holding valve 473, a branched passage 474, an internal remaining pressure holding valve 475, and a relief passage 476 are housed in the protrusion part 47. In other words, the protrusion part 47 integrally has the foregoing elements 470, 471, 472, 473, 474, 475, and 476 only on a side of the particular point S in the peripheral direction of the outer cylinder part 461.

The fuel passage 470 is a space in the protrusion part 47 and extends in an inverted U shape. The fuel passage 470 is divided by the partition wall 471 and thereby folded in the top-bottom direction. Owing to such a folding configuration, the fuel passage 470 has an upstream straight part 470*b* and a downstream straight part 470*c* which are substantially rectangular holes and extend downward, respectively, from both ends of a folding part 470*a* at an uppermost position.

The fuel passage 470 defines a communication port 470*e* opening at an intermediate part of the upstream straight part 470*b* in the top-bottom direction. By allowing the communication port 470*e* to communicate with the storage chamber 463 via the relay passage 465, the upstream straight part 470*b* is located downstream of the fuel filter 464. Owing to such an installation configuration, pressurized fuel guided through the relay passage 465 is introduced into the upstream straight part 470*b* from the communication port 470*e*. The upstream straight part 470*b* defines an external passage part 470*f* where the communication port 470*e* opens and an internal passage part 470*g* communicating with the communication port 470*e* via the external passage part 470*f*.

Fuel introduced from the communication port 470*e* flows into the external passage part 470*f* shown in FIG. 1. In the external passage part 470*f*, a part of the fuel introduced from the communication port 470*e* flows toward the external remaining pressure holding valve 473 located upper than the communication port 470*e*. A rest of the fuel introduced from the communication port 470*e* is branched from a flow toward the external remaining pressure holding valve 473. A branched flow of the fuel is returned toward the internal remaining pressure holding valve 475 below through the external passage part 470*f* and flows toward the internal passage part 470*g*. A flow of the fuel heading toward the internal remaining pressure holding valve 475 in the internal passage part 470*g* is made narrower than a flow of the fuel heading toward the external remaining pressure holding valve 473 in the external passage part 470*f*.

As is shown in FIG. 2, the discharge passage 472 is formed in a shape of a circular cylinder at an intermediate part of the protrusion part 47 in the top-bottom direction. The discharge passage 472 branches from the downstream straight part 470*c* located downstream of the communication port 470*e* and the external passage part 470*f* in the fuel passage 470. By allowing the discharge passage 472 to communicate with a discharge port 440 of the port member 44, fuel flowing the fuel passage 470 is discharged to the internal combustion engine 3 through the flexible tube 12*a* and the fuel supply tube 12. Fuel branched from a flow of supply headed toward the internal combustion engine 3 due to the discharge passage 472 flows the fuel passage 470 on a downstream of the discharge passage 472.

As are shown in FIGS. 1 and 2, the external remaining pressure holding valve 473 is a springless check valve and provided to the external passage part 470*f* located downstream of the communication port 470*e* and upstream of the discharge passage 472 in the upstream straight part 470*b*. The external remaining pressure holding valve 473 opens and closes the fuel passage 470 in the external passage part 470*f*. More specifically, the external remaining pressure holding valve 473 opens while pressurized fuel is introduced into the external passage part 470*f* from the communication port 470*e* in association with an operation of the fuel pump 42. While the external remaining pressure holding valve 473 is open, fuel to be introduced into the external passage part 470*f* flows toward the discharge passage 472 and a lowermost stream end 470*d* of the downstream straight part 470*c*. Meanwhile, the external remaining pressure holding valve 473 closes when introduction of fuel from the communication port 470*e* stops because the fuel pump 42 stops. While the external remaining pressure holding valve 473 is closed, a flow of fuel heading toward the discharge passage 472 and the lowermost stream end 470*d* is stopped. Hence, in the case of fuel discharged from the discharge passage 472 and supplied to the internal combustion engine 3 before the external remaining pressure holding valve 473 closes, a pressure of the fuel is held. That is, a remaining pressure holding function is exerted by the external remaining pressure holding valve 473 that is closed on fuel supplied to the internal combustion engine 3 through the fuel passage 470. A pressure held by the remaining pressure holding function of the external remaining pressure holding valve 473 is a pressure regulated when the fuel pump 42 is at rest.

The branched passage 474 is a space in the protrusion part 47 and extends toward the port member 44 from a point sandwiched between the relay passage 465 and the internal passage part 470*g* on a radially outside of the relay passage 465. The branched passage 474 is configured to branch and fold upward from a lower end of the internal passage part 470*g* on an opposite side to the external passage part 470*f*. By allowing the branched passage 474 to communicate with a jet port 441 of the port member 44, fuel ejected from the internal passage part 470*g* through the internal remaining pressure holding valve 475 is guided to the jet pump 50.

The internal remaining pressure holding valve 475 is a spring-pushed check valve and provided to the branched passage 474. The internal remaining pressure holding valve 475 opens and closes the fuel passage 470 which leads to the branched passage 474. More specifically, the internal remaining pressure holding valve 475 opens while fuel at or above a valve opening pressure is introduced into the passage parts 470*f* and 470*g* from the communication port 470*e* in association with an operation of the fuel pump 42. While the internal remaining pressure holding valve 475 is open, pressurized fuel which has flowed into the branched passage 474 from the internal passage part 470*g* flows toward the jet pump 50. Meanwhile, the internal remaining pressure holding valve 475 closes even when the fuel pump 42 is in operation in a case where a pressure of fuel introduced from the communication port 470*e* falls below a valve closing pressure or when introduction of fuel is stopped because the fuel pump 42 stops. While the internal remaining pressure holding valve 475 is closed, fuel stops flowing toward the jet pump 50. In particular, while the internal remaining pressure holding valve 475 is closed because the fuel pump 42 stops, the feed valve 421 is also closed and hence a pressure of fuel in the storage chamber 463 is held. That is, a remaining pressure holding function is exerted by the internal remaining pressure holding valve 475 that is closed on fuel remaining in the storage chamber 463. A pressure held by the remaining pressure holding function of the internal remaining pressure holding valve 475 is set to, for example, 250 kPa.

As is shown in FIG. 2, the relief passage 476 is a circular cylindrical hole provided at an intermediate part of the protruding part 47 in the top-bottom direction between the passages 472 and 474. The relief passage 476 branches from the downstream straight part 470*c* from a downstream of the discharge passage 472. By allowing the relief passage 476 to communicate with a relief port 442 of the port member 44, fuel branched from a flow of supply to the internal combustion engine 3 is guided to a relief valve 443 on a downstream of the external remaining pressure holding valve 473.

The port member 44 made of resin is formed in a hollow shape and provided from inside to outside of the sub-tank 20. As are shown in FIGS. 2 to 4, the port member 44 is joined to the protrusion part 47 at the particular point S by welding. The port member 44 protrudes laterally from the protrusion part 47. The port member 44 integrally has the discharge port 440, the jet port 441, the relief port 442, and the relief valve 443 on an outside of the filter case 43.

The discharge port 440 is an L-shape space defined in an upper part of the port member 44 in the top-bottom direction. The discharge port 440 communicates with the discharge passage 472 opening in a side surface 47*a* of the protrusion part 47 as is shown in FIG. 2. The discharge port 440 also communicates with the flexible tube 12*a* (see FIG. 1) by pointing a lowermost stream end upward on an opposite side to a point of communication with the discharge passage 472. The discharge port 440 having such a communication configuration leads to the fuel passage 470 via the discharge passage 472 and also leads to the internal combustion engine 3 via the flexible tube 12*a* and the fuel supply tube 12. Owing to the configuration as above, the discharge port 440 exerts a discharge function to the internal combustion engine 3 on fuel flowing from the fuel passage 470 to the discharge passage 472.

The jet port 441 is an inverted L-shaped space defined below the discharge port 440 of the port member 44. The jet port 441 communicates with the branched passage 474 opening in the side surface 47*a* and also communicates with the jet pump 50 on an opposite side to a point of communication with the branched passage 474. The jet port 441 having such a communication configuration leads to the internal passage part 470*g* via the branched passage 474 and also leads directly to the jet pump 50. Owing to the configuration as above, the jet port 441 exerts a guiding function to the jet pump 50 on fuel ejected from the fuel passage 470 through the internal remaining pressure holding valve 475.

The relief port 442 is a circular cylindrical stepped-hole provided at an intermediate part of the port member 44 in the top-bottom direction between the ports 440 and 441. The relief port 442 communicates with the relief passage 476 opening in the side surface 47*a*. The relief port 442 also communicates with the relief valve 443 on an opposite side to a point of communication with the relief passage 476. The relief port 442 having such a communication configuration leads to the fuel passage 470 via the relief passage 476 and also leads directly to the relief valve 443. Owing to the configuration as above, the relief port 442 exerts a guiding function to the relief valve 443 on fuel branched from a flow to the internal combustion engine 3 in the fuel passage 470.

The relief valve 443 is a spring-pushed check valve and communicates with the relief port 442. By allowing the relief valve 443 to communicate with an interior of the sub-tank 20, fuel guided to the relief port 442 can be ejected into the sub-tank 20. The relief valve 443 opens and closes the fuel passage 470 which leads to the relief port 442. More specifically, the relief valve 443 closes regardless of whether the fuel pump 42 is in operation or at rest while a pressure of the relief port 442 is below the valve opening pressure because a fuel supply path from the fuel passage 470 to the internal combustion engine 3 is held in a normal state. While the relief valve 443 is closed, fuel at a pressure regulated by an operation of the fuel pump 42 is discharged through the discharge passage 472 and the discharge port 440. Hence, a pressure substantially as high as a pressure-regulated value at the fuel pump 42 can be secured for fuel to be supplied to the internal combustion engine 3. Meanwhile, the relief valve 443 opens regardless of whether the fuel pump 42 is in operation or at rest when fuel at or above the valve opening pressure is guided from the relief port 442 in the event of an abnormality in the fuel supply path from the fuel passage 470 to the internal combustion engine 3. While the relief valve 443 is open, fuel guided to the relief valve 443 is ejected into the sub-tank 20. A pressure of fuel to be supplied to the internal combustion engine 3 is thus released. That is, a relief function is exerted by the relief valve 443 that is opened on fuel to be supplied to the internal combustion engine 3. A valve opening pressure for the relief function of the relief valve 443 is set to, for example, 650 kPa.

Figure 5:
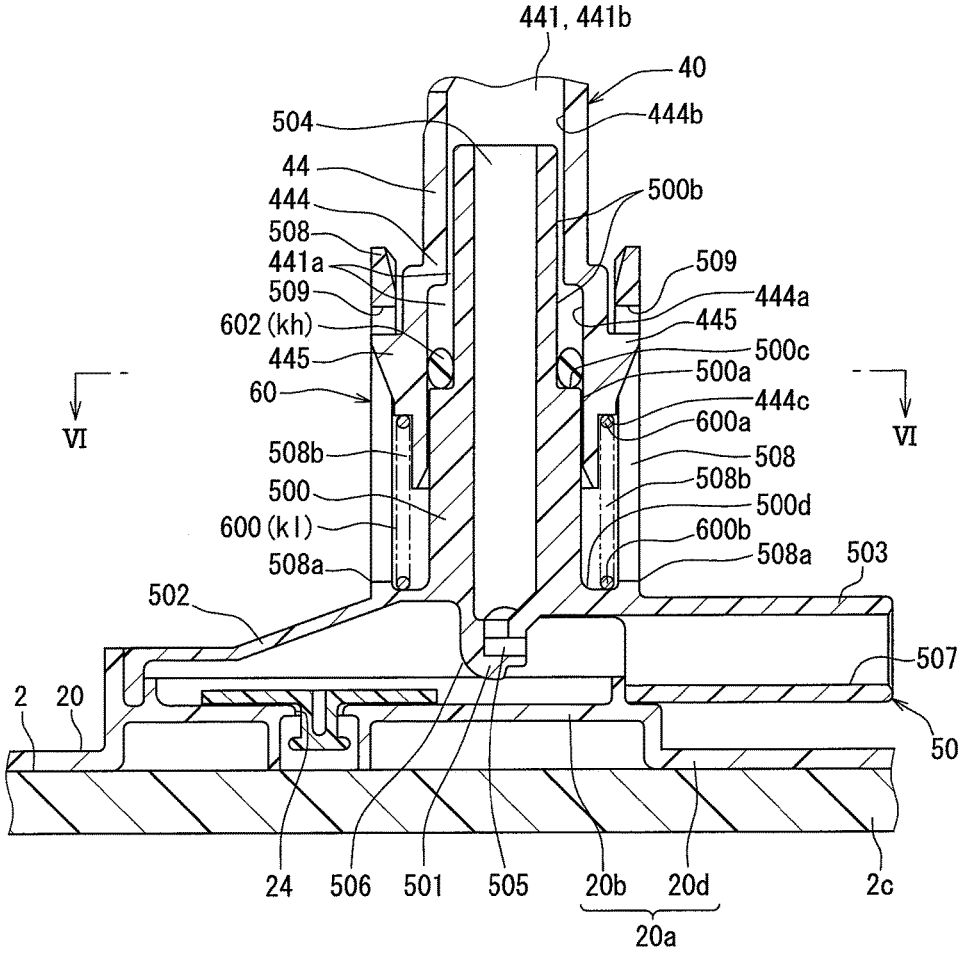
FIG. 5 is the cross section of FIG. 2 partly enlarged.

As are shown in FIGS. 2 and 5, the jet pump 50 made of resin is formed in a hollow shape and installed inside the sub-tank 20. The jet pump 50 is installed on the recessed bottom 20*b* in the bottom 20*a* of the sub-tank 20 and connected with the port member 44 of the pump unit 40 above. The jet pump 50 integrally has a pressurizing part 500, a nozzle part 501, an intake part 502, and a diffuser part 503.

The pressurizing part 500 enters the port member 44 from below. The pressurizing part 500 defines a pressurizing passage 504 which is a circular cylindrical hole extending in the top-bottom direction. The pressurizing passage 504 communicates with the jet port 441 in the port member 44. The nozzle part 501 defines a nozzle passage 505 which is a circular cylindrical hole extending laterally from the pressurizing part 500. The nozzle passage 505 communicates with the pressurizing passage 504. Owing to the configuration as above, pressurized fuel ejected from the internal passage part 470*g* through the internal remaining pressure holding valve 475 is guided successively to the pressurizing passage 504 and the nozzle passage 505 from the jet port 441 of a guide part 444.

The intake part 502 is attached to the recessed bottom 20*b* by fitting or light press-fitting. The intake part 502 defines an intake passage 506 which is a flat space expanding under the pressurizing part 500 and the nozzle part 501. The intake passage 506 communicates with the inflow port 24. The diffuser part 503 defines a diffuser passage 507 which is a circular cylindrical hole extending laterally from the nozzle part 501. The diffuser passage 507 communicates with the nozzle passage 505 and the intake passage 506 and also communicates with the interior of the sub-tank 20 on an opposite side to points of communication with the passages 505 and 506. Owing to the configuration as above, when pressurized fuel guided to the nozzle passage 505 is jetted to the diffuser passage 507 and a negative pressure is formed around a flow of jet, fuel stored in the fuel tank 2 is drawn sequentially into the intake passage 506 and the diffuser passage 507 from the inflow port 24. The fuel drawn in the manner as above is press-fed under an action of a diffuser by the diffuser passage 507 and is thus pumped into the sub-tank 20.

A connection structure 60 connected with the pump unit 40 and the jet pump 50 will now be described in detail. In the following, the bottom 20*a* of the sub-tank 20 is referred to also simply as the bottom 20*a*.

As are shown in FIGS. 2 and 4 to 6, the connection structure 60 has the guide part 444 provided to the pump unit 40 and the pressurizing part 500 provided to the jet pump 50 plus a shock-absorbing member 600 and a sealing member 602.

Figure 6:
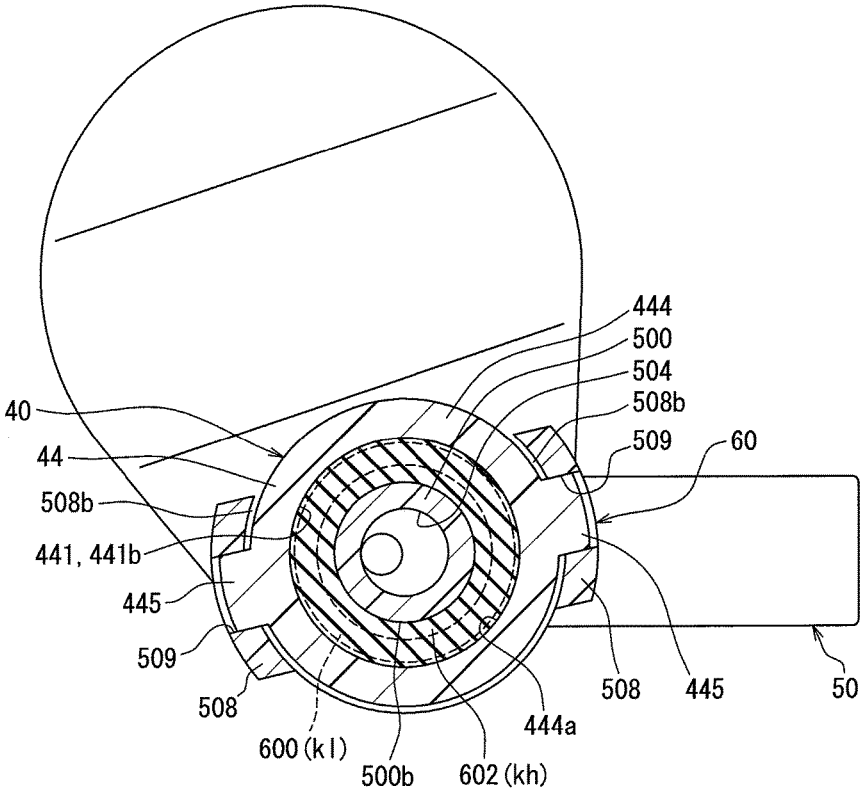
FIG. 6 is a cross section taken along the line VI-VI of FIG. 5.

As are shown in FIGS. 5 and 6, the guide part 444 is formed in a shape of a circular cylinder opening downward in the port member 44 of the pump unit 40. The guide part 444 is disposed with an axial direction aligned in the top-bottom direction. An inner peripheral surface of the guide part 444 is divided in an axial direction into a large-diameter inner peripheral surface 444*a* and a small-diameter inner peripheral surface 444*b* above having a diameter smaller than that of the large-diameter inner peripheral surface 444*a*. By defining a downstream port part 441*b* (see also FIG. 2) extending in the top-bottom direction in the jet port 441 by the inner peripheral surfaces 444*a* and 444*b*, pressurized fuel is guided by the guide part 444 toward the bottom 20*a* in the axial direction.

The pressurizing part 500 is formed in a shape of a circular cylinder opening upward in the jet pump 50. The pressurizing part 500 is disposed with an axial direction aligned in the top-bottom direction and therefore coaxially inserted in the guide part 444 on an inner peripheral side. The pressurizing part 500 defines the pressurizing passage 504 communicating with the downstream port part 441*b* to let fuel guided from the guide part 444 flow toward the bottom 20*a* in the axial direction.

As is shown in FIG. 5, a supporting surface 500*a* and a loose insertion surface 500*b* are provided to an outer peripheral surface of the pressurizing part 500. The supporting surface 500*a* is in a shape of a circular cylindrical surface with a predetermined diameter. The supporting surface 500*a* is disposed coaxially with the large-diameter inner peripheral surface 444*a* on an inner peripheral side and thereby is fitted to the guide part 444 from a side of the bottom 20*a* in an axially slidable manner. Owing to such a fitting configuration, the supporting surface 500*a* slidably supports the guide part 444 from the inner peripheral side. The loose insertion surface 500*b* is in a shape of a circular cylindrical surface having a smaller diameter than the supporting surface 500*a* and located upper than the supporting surface 500*a*. The loose insertion surface 500*b* is disposed coaxially with the inner peripheral surfaces 444*a* and 444*b* on the inner peripheral side and thereby loosely inserted in the guide part 444 from the side of the bottom 20*a* with a radial clearance 441*a*. It should be noted that pressurized fuel is allowed to enter the radial clearance 441*a* from the jet port 441.

The pressurizing part 500 is also provided with a shoulder surface 500*c*. The shoulder surface 500*c* is in a shape of an annular flat surface facing upward between the supporting surface 500*a* and the loose insertion surface 500*b*. From the shoulder surface 500*c*, the supporting surface 500*a* continues to a side of the bottom 20*a* in the axial direction and the loose insertion surface 500*b* continues to an opposite side in the axial direction.

As are shown in FIGS. 4 to 6, the shock-absorbing member 600 made of metal is formed in a spring shape and has a low spring constant kl that is predetermined as a spring constant of axial deformation. The shock-absorbing member 600 is provided in the sub-tank 20 and coaxially located outside the pressurizing part 500 and outside the guide part 444. The shock-absorbing member 600 is located on an outer peripheral side of the guide part 444 and an outer peripheral side of the pressurizing part 500 with an axial direction aligned in the top-bottom direction. As is shown in FIG. 5, an upper end 600*a* of the shock-absorbing member 600 is stopped on an outer peripheral side of the supporting surface 500*a* by a stopping surface 444*c* provided to the guide part 444 and formed in a shape of an annular flat surface facing downward. A lower end 600*b* of the shock-absorbing member 600 is stopped on the outer peripheral side of the supporting surface 500*a* by a stopping surface 500*d* provided to the pressurizing part 500 and formed in a shape of an annular flat surface facing upward. Owing to such a stopping configuration, the shock-absorbing member 600 is capable of mitigating an axial impact when interposed axially between the guide part 444 and the pressurizing part 500. As has been described above, the elastic parts 324 (see FIG. 1) are interposed between the pump unit 40 and the sub-tank 20 besides the shock-absorbing member 600. The pump unit 40 is thus supported on the sub-tank 20 in substantially a floating condition.

As are shown in FIGS. 5 and 6, the sealing member 602 made of rubber is formed in an O-ring shape and has a high spring constant kh higher than the low spring constant kl of the shock-absorbing member 600 as a spring constant of radial deformation. The sealing member 602 is provided inside the sub-tank 20 and coaxially located outside the pressurizing part 500 and inside the guide part 444. The sealing member 602 is radially pinched between the guide part 444 on an outer peripheral side and the pressurizing part 500 on an inner peripheral side with an axial direction aligned in the top-bottom direction. As is shown in FIG. 5, the sealing member 602 of the present embodiment is press-fit coaxially between the large-diameter inner peripheral surface 444*a* of the guide part 444 and the loose insertion surface 500*b* of the pressurizing part 500 and is thus compressed radially. Also, the sealing member 602 of the present embodiment is stopped by the shoulder surface 500*c* beneath the self from the side of the bottom 20*a*. While the sealing member 602 configured as above is under a pressure of pressurized fuel in the radial clearance 441*a* between the guide part 444 and the pressurizing part 500, the sealing member 602 is pressed against the shoulder surface 500*c* and thereby becomes capable of sealing the radial clearance 441*a* radially.

As are shown in FIGS. 4 to 6, the connection structure 60 further has a guide part 508 and an engaging window part 509 provided to the jet pump 50 and an engaging claw part 445 provided to the pump unit 40.

The guide part 508 is provided to the jet pump 50 on both sides radially sandwiching the pressurizing part 500, that is, one on each side. Each guide part 508 is formed in a shape of an arc plate extending in the top-bottom direction and disposed coaxially with the pressurizing part 500 and the guide part 444. Each guide part 508 guides the shock-absorbing member 600, which is to be located in a radial clearance 508*b* between the self and the pressurizing part 500, in the top-bottom direction along the axial direction. Each guide part 508 is provided with the engaging window part 509 which is a rectangular hole extending in the top-bottom direction along an axial direction of the pressurizing part 500.

The engaging claw part 445 is provided to the pump unit 40 on both radial side parts of the guide part 444, that is, one in each side part. Each engaging claw part 445 is formed in a shape of a hook protruding radially outward from the guide part 444. Each engaging claw part 445 enters the corresponding engaging window part 509 and is therefore pinched from both sides in a width direction. Each engaging claw part 445 is thus allowed to slide in the axial direction. As is shown in FIG. 5, a lower end 508*a* of each guide part 508 of the present embodiment is held by the intake part 502. Owing to such a configuration, each guide part 508 is elastically deformable in the radial direction of the pressurizing part 500. Accordingly, when the fuel supply device 1 is manufactured, each guide part 508 is pressed by a corresponding engaging claw part 445 and undergoes elastic deformation while the pressurizing part 500 is put into the guide part 444. Eventually, each guide part 508 elastically restores to an original shape while a corresponding engaging window part 509 externally is fitted to a corresponding engaging claw part 445. Hence, an engaging state of each engaging claw part 445 to the corresponding engaging window part 509 can be realized by snap-fitting using elastic deformation and elastic restoration of the corresponding guide part 508.

A functional effect of the first embodiment will now be described in the following.

In the connection structure 60 connected with the pump unit 40 and the jet pump 50 in the first embodiment, the pressurizing part 500 of the jet pump 50 is fitted to the guide part 444 of the pump unit 40 in an axially slidable manner from the side of the bottom 20*a* of the sub-tank 20. Owing to such a fitting configuration of the guide part 444 and the pressurizing part 500, the shock-absorbing member 600 having the low spring constant kl mitigates an axial impact between the guide part 444 and the pressurizing part 500. Hence, even when an impact of relatively large amplitude is made to the jet pump 50 installed on the bottom 20*a* while the vehicle is moving, the impact which has propagated from the side of the bottom 20*a* to the pressurizing part 500 can be mitigated by the shock-absorbing member 600 having the low spring constant kl. Consequently, because the pump unit 40 hardly receives an external impact directly, an occurrence of a failure can be restricted.

According to the first embodiment, owing to the fitting configuration of the guide part 444 and the pressurizing part 500 as above, the sealing member 602 having the high spring constant kh higher than the low spring constant kl of the shock-absorbing member 600 radially seals a space between the guide part 444 and the pressurizing part 500. Accordingly, by using the sealing member 602 having the high spring constant kh and capable of limiting fuel leakage in a guide path from the guide part 444 toward the pressurizing part 500, vibrations of relatively small amplitude generated in association with a fuel supplying operation of the pump unit 40 can be attenuated between the guide part 444 and the pressurizing part 500. Hence, because vibrations from the pump unit 40 hardly propagate directly to the jet pump 50 installed on the bottom 20*a*, generation of noise due to vibrations of the fuel tank 2 holding the sub-tank 20 and further vibrations of components forming the vehicle can be restricted.

According to the first embodiment, the pressurizing part 500 is inserted in the guide part 444 on the inner peripheral side and the sealing member 602 between the pressurizing part 500 and the guide part 444 is stopped by the shoulder surface 500*c* of the pressurizing part 500 from the side of the bottom 20*a* in the axial direction. The sealing member 602 between the guide part 444 and the pressurizing part 500 is thus capable of exerting not only the sealing function but also a vibration attenuation function in a stable manner. Consequently, reliability of a noise generation restricting effect can be increased. Moreover, because the sealing member 602 exerts the sealing function on pressurized fuel which has entered the space between the guide part 444 and the pressurizing part 500 on the inner peripheral side of the guide part 444, the shoulder surface 500*c* is pressed against the bottom 20*a* by the pressurized fuel via the sealing member 602. Consequently, because the jet pump 50 can be positioned while being pressed against the bottom 20*a* of the sub-tank 20, reliability of a fuel pumping function can be increased.

The guide part 444 of the first embodiment is slidably supported from the inner peripheral side on the supporting surface 500*a* of the pressurizing part 500 continuing from the shoulder surface 500*c* to the side of the bottom 20*a* in the axial direction. Hence, because radial positional displacement between the guide part 444 and the pressurizing part 500 can be restricted at the slidably supported point, the sealing member 602 stopped by the shoulder surface 500*c* near the slidably supported point can be positioned between the guide part 444 and the pressurizing part 500. Consequently, by letting the sealing member 602 between the guide part 444 and the pressurizing part 500 exert not only the sealing function but also the vibration attenuation function in a reliable and stable manner, reliability of the noise generation restricting effect can be increased.

The guide part 444 of the first embodiment stops the shock-absorbing member 600 on the outer peripheral side of the supporting surface 500*a* which slidably supports the guide part 444. Hence, the guide part 444 hardly tilts with respect to the axial direction even under an elastic restoration force of the shock-absorbing member 600. Consequently, an inconvenience that a positioning function of the sealing member 602 between the guide part 444 and the pressurizing part 500 is interfered with by an elastic restoring force of the shock-absorbing member 600 can be avoided. Hence, by letting the sealing member 602 exert not only the sealing function but also the vibration attenuation function in a reliable and stable manner between the guide part 444 and the pressurizing part 500, reliability of the noise generation restricting effect can be increased.

The shock-absorbing member 600 of the first embodiment is disposed outside the guide part 444 and outside the pressurizing part 500. Hence, the shock-absorbing member 600 does not interfere with the guiding function for pressurized fuel heading from the guide part 444 toward the pressurizing part 500. Consequently, because the fuel pumping function can be exerted in a stable manner by jetting pressurized fuel guided to the pressurizing part 500, reliability of the pumping function can be increased.

The pump unit 40 and the jet pump 50 of the first embodiment can be readily connected with each other by elastically engaging the engaging claw parts 445 of one of the pump unit 40 and the jet pump 50 to the engaging window parts 509 of the other one of the pump unit 40 and the jet pump 50 by snap-fitting. Moreover, after the pump unit 40 and the jet pump 50 are connected as above, each engaging claw part 445 is allowed to slide axially on the corresponding engaging window part 509. Hence, a shock-absorbing function of the shock-absorbing member 600 to mitigate an impact is not interfered with even when the pressurizing part 500 is axially slid on the guide part 444. Owing to the configuration as above, an inconvenience that the pump unit 40 fails to properly operate upon receipt of an impact directly can be restricted in a reliable manner while increasing productivity during manufacturing of the fuel supply device 1.

The pump unit 40 of the first embodiment is elastically supported not only by the shock-absorbing member 600 between the pump unit 40 and the pressurizing part 500 of the jet pump 50 from the side of the bottom 20*a*, but also by the top part 20*c* of the sub-tank 20 from the side of the bottom 20*a*. Hence, vibrations from the pump unit 40 hardly propagate directly to either the bottom 20*a* or the top part 20*c*. Consequently, a restricting effect on generation of noise due to vibrations of the fuel tank 2 holding the sub-tank 20 and further vibrations of components forming the vehicle can be increased.

Second Embodiment

A second embodiment of the present disclosure is a modification of the first embodiment above. In the second embodiment, a pressure of pressurized fuel discharged from a fuel pump 2042 shown in FIG. 7 is fixed to, for example, 400 kPa.

Figure 7:
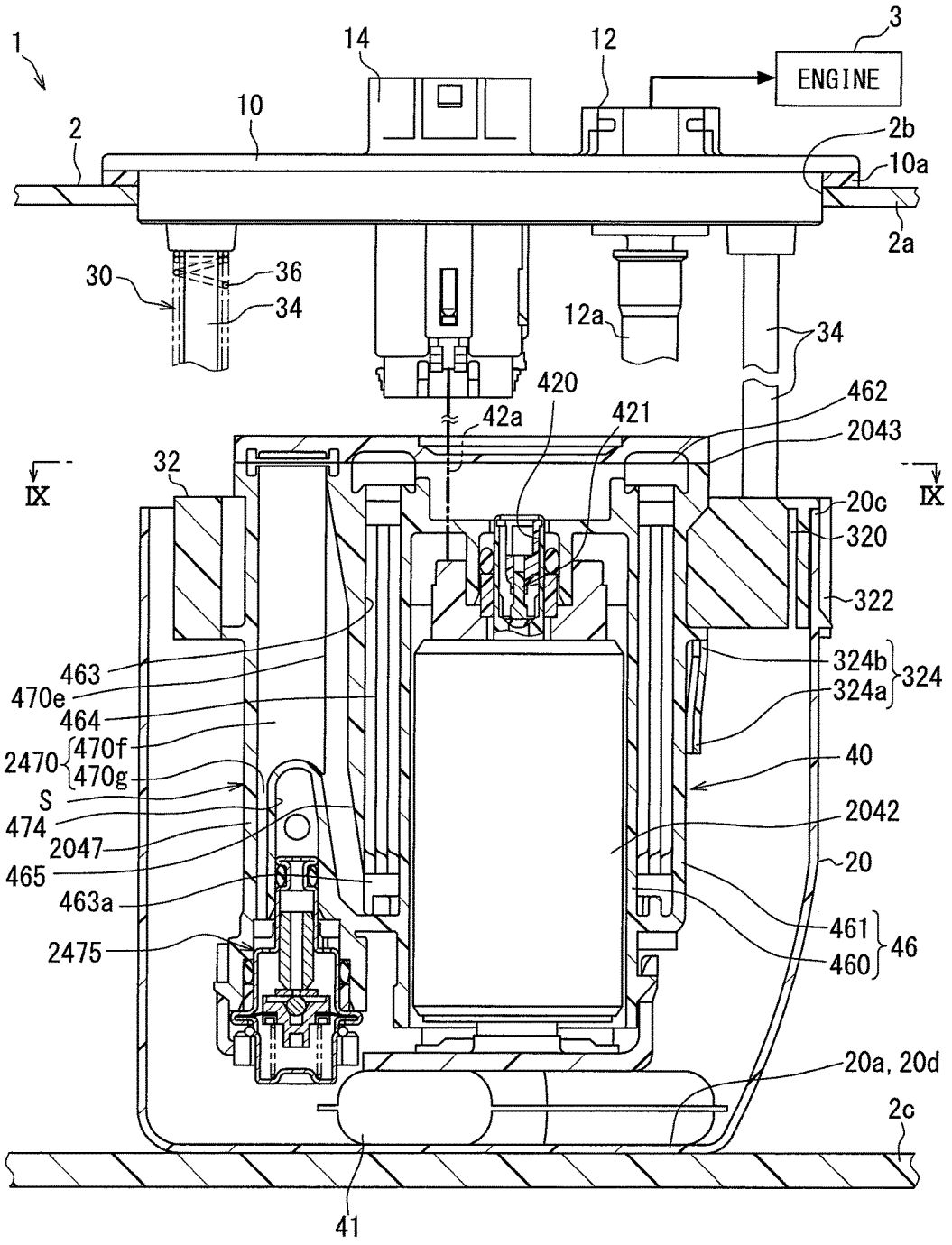
FIG. 7 is a cross section of a fuel supply device of a second embodiment taken along the line VII-VII of FIG. 9.
Figure 8:
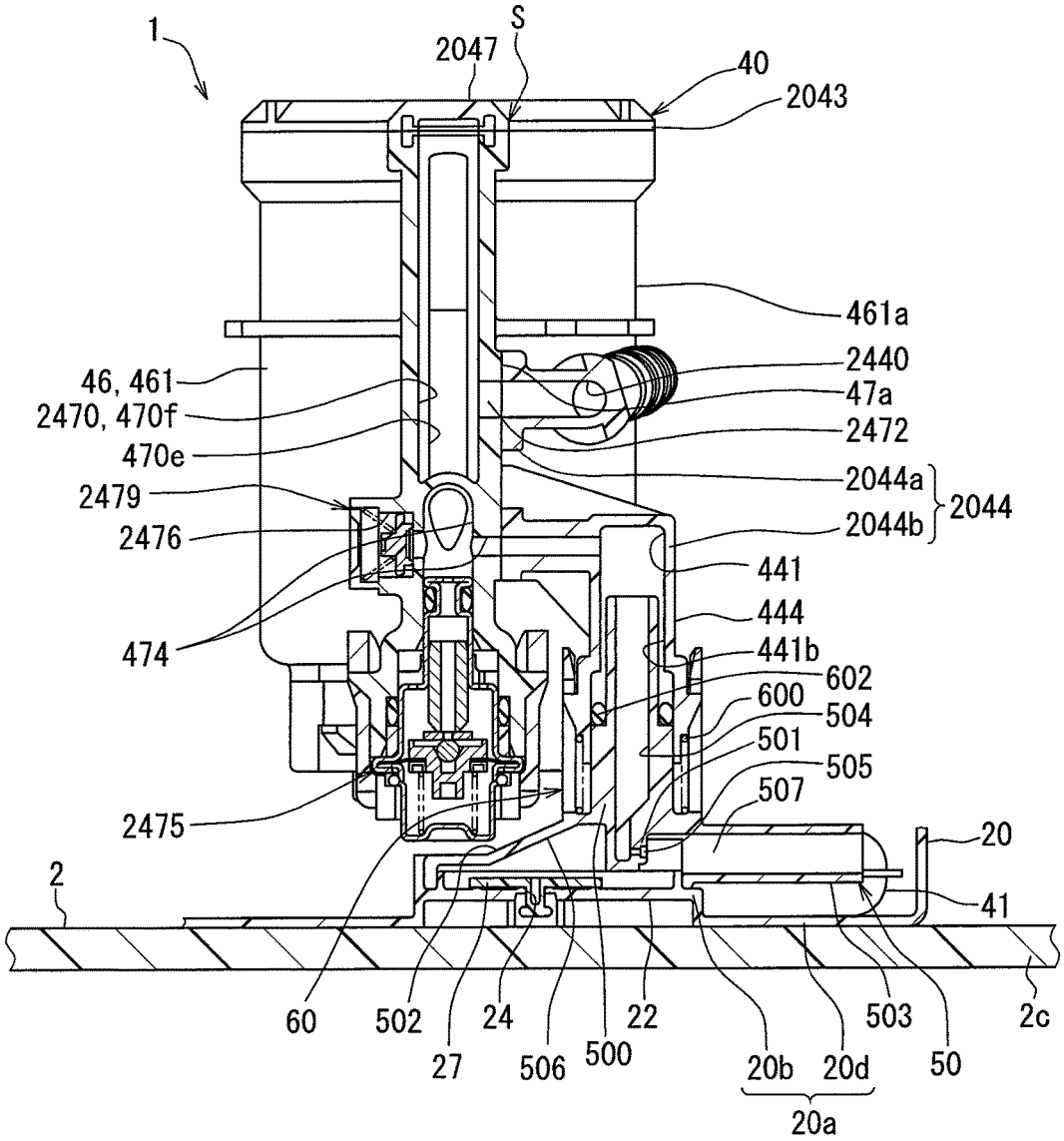
FIG. 8 is a cross section taken along the line VIII-VIII of FIG. 9.
Figure 9:
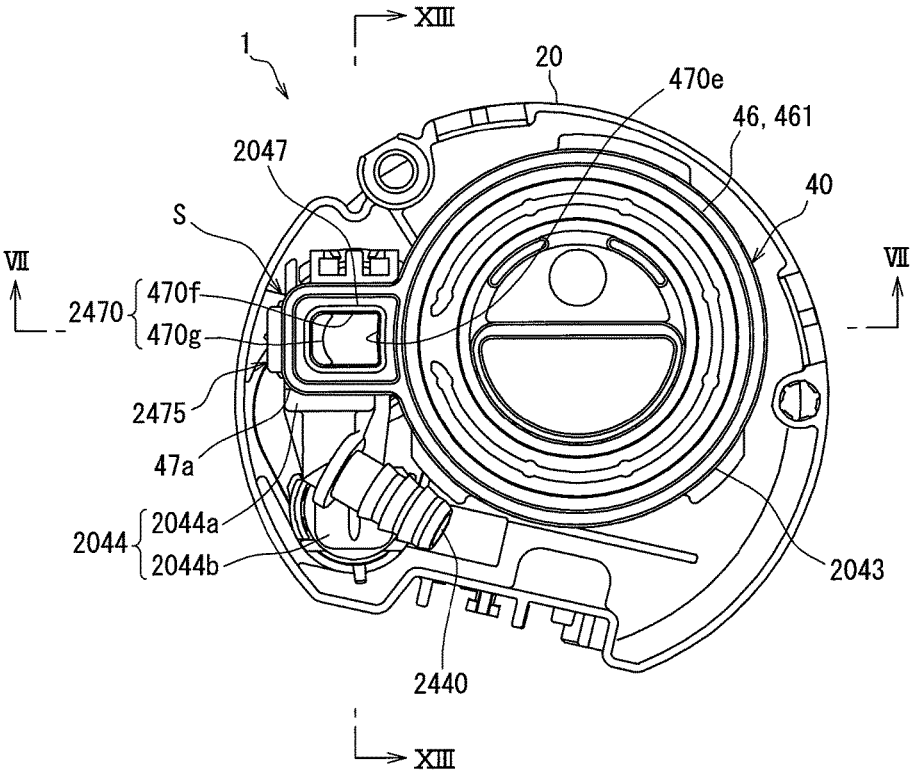
FIG. 9 is a cross section taken along the line IX-IX of FIG. 7.

As are shown in FIGS. 7 to 9, a fuel passage 2470 of the second embodiment is substantially a square hole extending straight in a top-bottom direction in a protrusion part 2047 of a filter case 2043. The communication port 470*e* is opened at an intermediate part of the fuel passage 2470 in the top-bottom direction. By allowing the communication port 470*e* to communicate with the storage chamber 463 via the relay passage 465 shown in FIG. 7, the fuel passage 2470 is located downstream of the fuel filter 464. Owing to such an installation configuration, pressurized fuel guided through the relay passage 2465 is introduced into the fuel passage 2470 from the communication port 470*e*.

In the second embodiment, as are shown in FIGS. 7 to 9, the external passage part 470*f* and the internal passage part 470*g* defined in the fuel passage 2470 are housed in the protrusion part 2047 with elements 2472, 474, 2475, 2476, and 2479 at a particular point S. In the external passage part 470*f* of the second embodiment without the partition wall 471 and the external remaining pressure holding valve 473, fuel introduced from the communication port 470*e* flows toward a discharge passage 2472 located upper than the communication port 470*e*. Except for the configuration as above, the fuel passage 2470 is configured in a same manner as the fuel passage 470 described in the first embodiment above.

Figure 10:
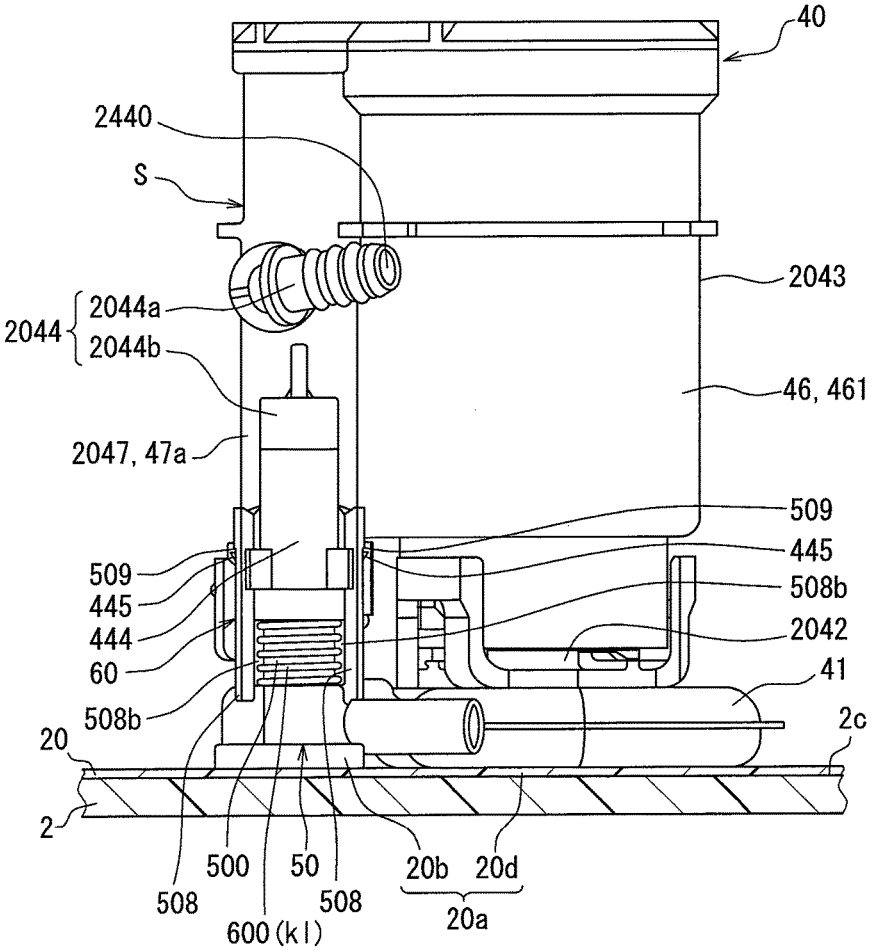
FIG. 10 is a partial cross section of the fuel supply device of FIG. 7.

As are shown in FIGS. 8 and 10, the discharge passage 2472 is provided at an intermediate part of the protrusion part 2047 in the top-bottom direction in a shape of a circular cylinder located upper than the communication port 470*e*. The discharge passage 2472 branches from the external passage part 470*f* of the fuel passage 2470 at a point downstream of the communication port 470*e*. Except for the configuration described above, the discharge passage 2472 is configured in a same manner as the discharge passage 472 described in the first embodiment above.

As are shown in FIGS. 7 and 8, a spring reactive force of an internal remaining pressure holding valve 2475 is set differently from the first embodiment above. Hence, while the internal remaining pressure holding valve 2475 is open, a pressure of pressurized fuel heading from the external passage part 470*f* to the discharge passage 2472 is adjusted to, for example, 400 kPa. Herein, pressurized fuel which has flowed into the branched passage 474 from the internal passage part 470*g* flows toward the jet pump 50 and a relief valve 2479. However, the fuel stops flowing while the internal remaining pressure holding valve 2475 is closed. Consequently, a pressure held by a remaining pressure holding function of the internal remaining pressure holding valve 2475 that is closed is, for example, 400 kPa. Except for the configuration as above, the internal remaining pressure holding valve 2475 is configured in a same manner as the internal remaining pressure holding valve 475 described in the first embodiment above.

As is shown in FIG. 8, a relief passage 2476 is a circular cylindrical stepped-hole provided at an intermediate part of the protrusion part 2047 in the top-bottom direction between the discharge passage 2472 and the internal remaining pressure holding valve 2475. The relief passage 2476 branches from the branched passage 474 at a point located downstream of the internal remaining pressure holding valve 2475 and also communicates with the relief valve 2479 on an opposite side to a point of branch from the branched passage 474. Owing to such a branching and communication configuration, the relief passage 2476 guides fuel ejected from the internal passage part 470*g* through the internal remaining pressure holding valve 2475 to the relief valve 2479.

As is shown in FIG. 7, the relief valve 2479 is a spring-pushed check valve and communicates with the relief passage 2476. By allowing the relief valve 2479 to communicate with an interior of the sub-tank 20, fuel guided to the relief passage 2476 can be ejected into the sub-tank 20. The relief valve 2479 opens and closes the fuel passage 2470 which leads to the relief passage 2476 via the branched passage 474. More specifically, the relief valve 2479 closes regardless of whether the fuel pump 2042 is in operation or at rest while a pressure of the relief passage 2476 is below a valve opening pressure because the internal remaining pressure holding valve 2475 is closed. While the relief valve 2479 is closed, the internal remaining pressure holding valve 2475 is also closed. Hence, fuel does not flow toward the jet pump 50. Meanwhile, the relief valve 2479 opens when fuel at or above the valve opening pressure is ejected by the internal remaining pressure holding valve 2475 from the internal passage part 470*g* because the internal remaining pressure holding valve 2475 opens in association with an operation of the fuel pump 2042. While the relief valve 2479 is open, fuel is ejected into the sub-tank 20 from the internal passage part 470*g* through the internal remaining pressure holding valve 2475. A pressure of fuel heading toward the jet pump 50 is thus released. That is, a relief function is exerted by the relief valve 2479 that is opened on fuel ejected from the fuel passage 2470 by the internal remaining pressure holding valve 2475. A valve opening pressure for the relief function of the relief valve 2479 is set to, for example, 50 kPa.

In the second embodiment, as are shown in FIGS. 8 to 10, a port member 2044 without the relief port 442 and the relief valve 443 is divided to two in a top-bottom direction. In the port member 2044 as above, a port forming body 2044*a* on an upper side forms a discharge port 2440 while a port forming body 2044*b* on a lower side forms the jet port 441 using the guide part 444 or the like. Except for the configuration as above and a configuration that a lowermost stream end of the discharge port 2440 is faced laterally, the port member 2044 is configured in a same manner as the port member 44 and the discharge port 440 described in the first embodiment above.

According to the second embodiment as above, too, the pump unit 40 including elements 41, 2042, 2043, 2044, and so on is connected with the jet pump 50 by the connection structure 60 substantially same as a counterpart of the first embodiment above. Consequently, a functional effect same as the functional effect of the first embodiment above can be achieved.

Other Embodiments

While the above has described the embodiments of the present disclosure, it should be appreciated that an interpretation of the present disclosure is not limited by the embodiments above and the present disclosure is applicable to various other embodiments, either solely or in combination, within the scope of the present disclosure.

Figure 11:
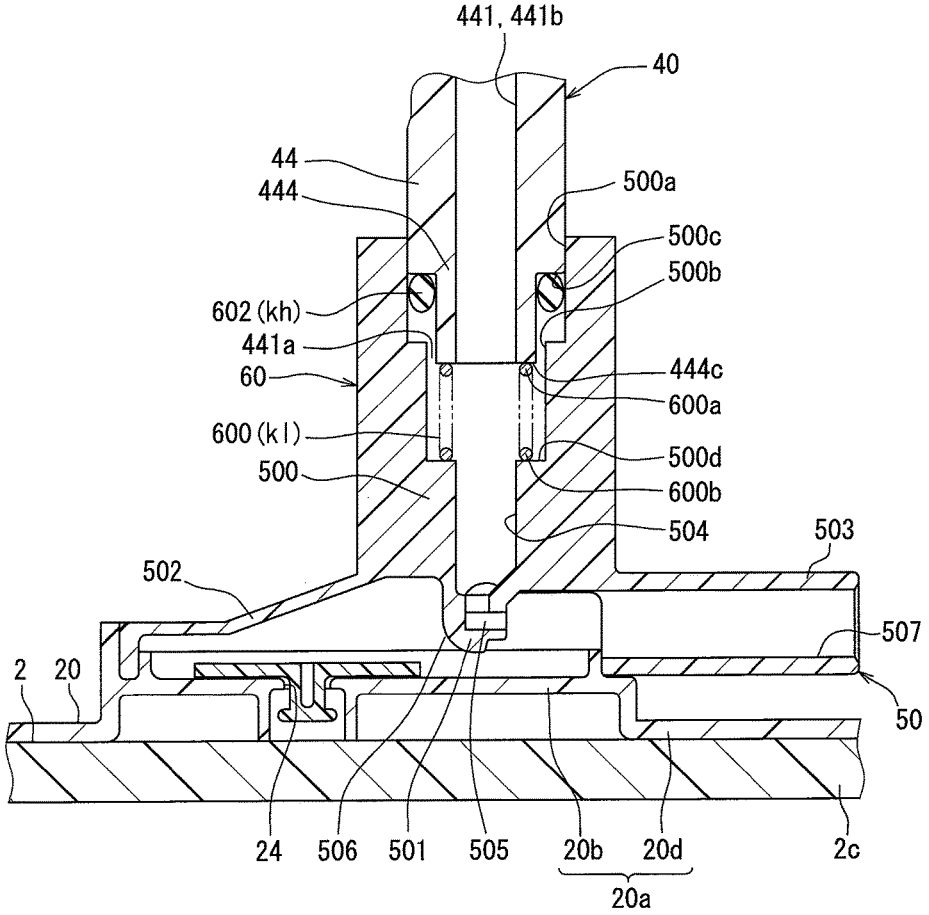
FIG. 11 is a cross section of a modification of a configuration of FIG. 5.

More specifically, according to a first modification of the first and second embodiments above, as is shown in FIG. 11, the guide part 444 may be inserted in the pressurizing part 500 on an inner peripheral side. In the first modification of FIG. 11, the supporting surface 500*a* formed of an inner peripheral surface of the pressurizing part 500 is disposed coaxially with the guide part 444 on an outer peripheral side and thereby is fitted to the guide part 444 from the side of the bottom 20*a* in an axially slidable manner. Also, the loose insertion surface 500*b* formed of the inner peripheral surface of the pressurizing part 500 of the first modification of FIG. 11 is disposed coaxially with the guide part 444 on the outer peripheral side and thereby externally inserted in the guide part 444 from the side of the bottom 20*a* with the radial clearance 441*a*. In short, the guide part 444 is loosely inserted on the inner peripheral side of the loose insertion surface 500*b*. Further, the shoulder surface 500*c* of the first modification of FIG. 11 is provided to the guide part 444 to face downward, that is, toward the bottom 20*a* of the sub-tank 20.

Figure 12:
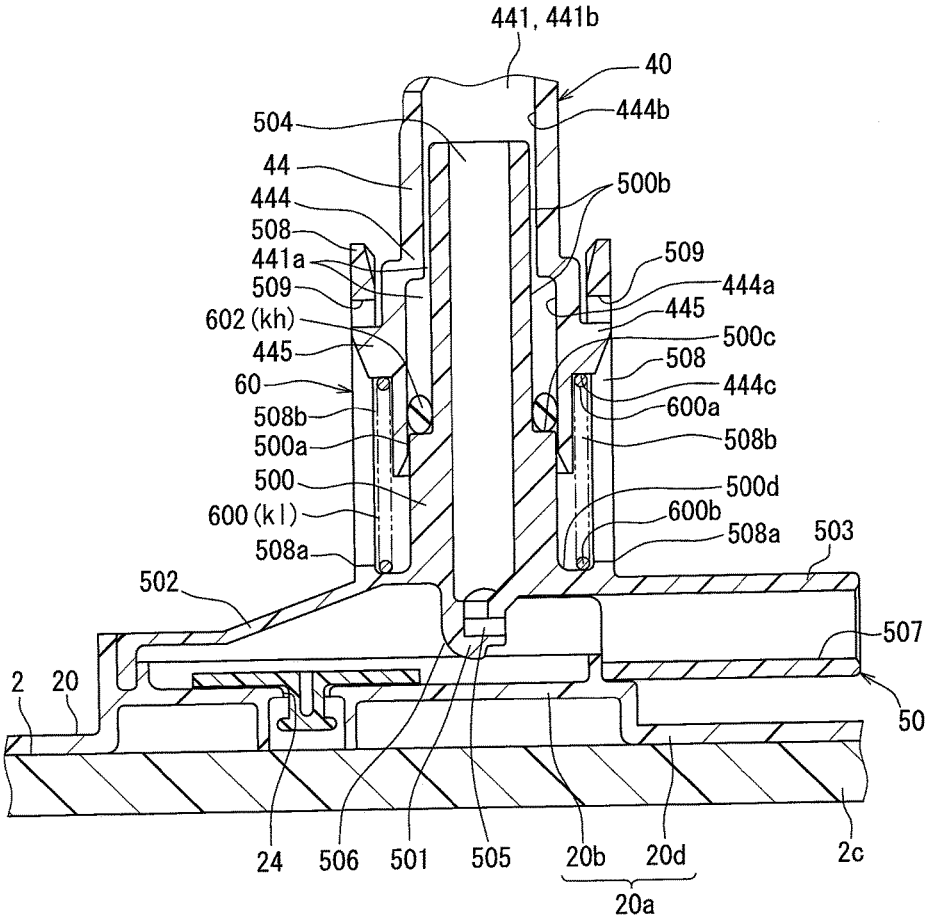
FIG. 12 is a cross section of another modification of the configuration of FIG. 5.

According to a second modification of the first and second embodiments above, the supporting surface 500*a* may be provided to have a diameter larger than an outer rim of the shoulder surface 500*c* at a position spaced apart from the shoulder surface 500*c* toward the bottom 20*a* in the axial direction. According to a third modification of the first and second embodiments above, as is shown in FIG. 12, the shock-absorbing member 600 may be stopped by the guide part 444 at a position axially off from the outer peripheral side of the supporting surface 500*a*. According to a fourth modification of the first and second embodiments above, the shock-absorbing member 600 may be disposed inside the guide part 444 or inside the pressurizing part 500 or inside the both parts 444 and 500.

Figure 13:
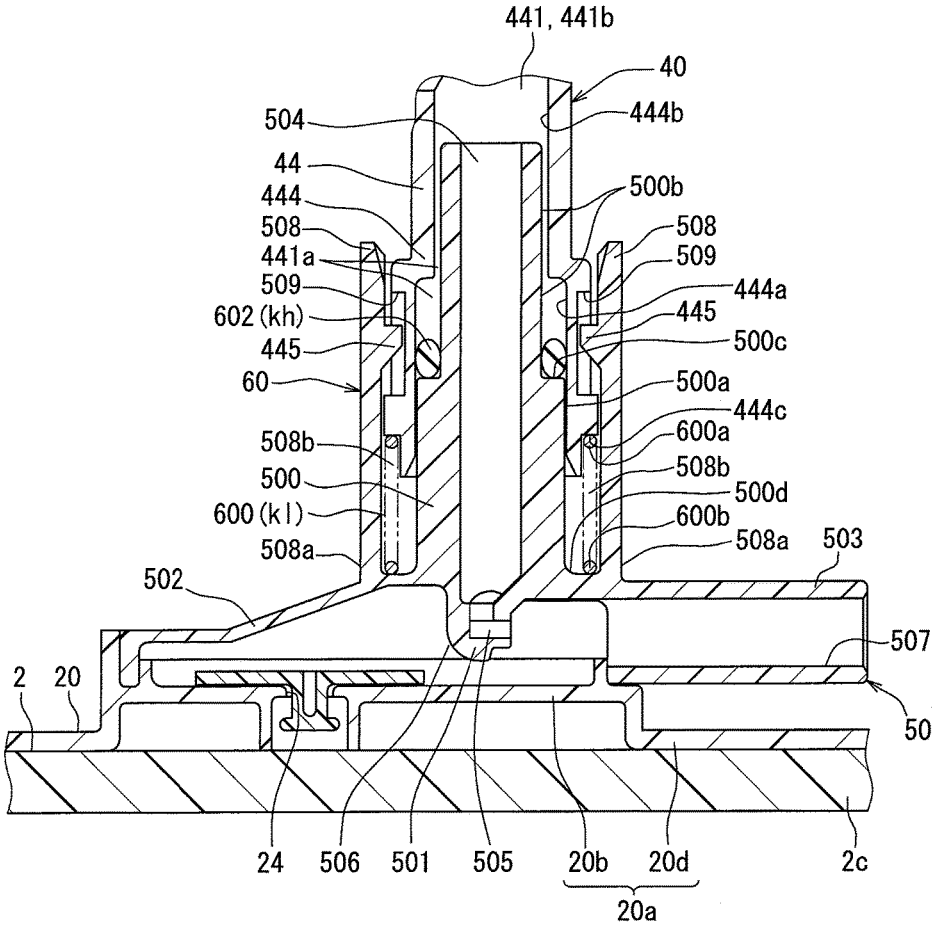
FIG. 13 is a cross section of still another modification of the configuration of FIG. 5.

According to a fifth modification of the first and second embodiments above, as is shown in FIG. 13, the engaging window parts 509 may be provided to the pump unit 40 while the engaging claw parts 445 and the guide parts 508 may be provided to the jet pump 50. When a fuel supply device of the fifth modification shown in FIG. 13 is manufactured, each engaging claw part 445 is pressed by the guide part 444 and the corresponding guide part 508 undergoes elastic deformation while the pressurizing part 500 is put into the guide part 444. Eventually, each guide part 508 elastically restores to an original shape while the corresponding engaging claw part 445 enters the corresponding engaging window part 509. In the manner as above, in the fifth modification shown in FIG. 13, too, an engaging state of each engaging claw part 445 to the corresponding engaging window part 509 can be realized by snap-fitting using elastic deformation and elastic restoration of the corresponding guide part 508.

According to a sixth modification of the first and second embodiments above, the guide parts 508, the engaging window parts 509, and the engaging claw parts 445 may not necessarily be combined in the manner shown in FIG. 11. According to a seventh modification of the first and second embodiments above, a part of the pump unit 40 may be fixed to the sub-tank 20. Even in the seventh modification as above, the functional effects of the present disclosure can be expected in a propagation path of an impact and vibrations between the pump unit 40 and the jet pump 50.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A fuel supply device which supplies a fuel in a fuel tank to an internal combustion engine outside the fuel tank in a vehicle, comprising:

a sub-tank held inside the fuel tank;

a pump unit housed in the sub-tank and discharging the fuel stored in the sub-tank to the internal combustion engine by pressurizing the fuel;

a jet pump installed on a bottom of the sub-tank to pump the fuel stored in the fuel tank into the sub-tank by jetting a pressurized fuel guided from the pump unit; and a connection structure connected with the pump unit and the jet pump, wherein the connection structure has a guide part being a cylindrical shape, the guide part provided to the pump unit, and the guide part guiding the pressurized fuel toward the bottom in an axial direction, a pressurizing part being a cylindrical shape, the pressurizing part provided to the jet pump, and the pressurizing part being fitted to the guide part from a side of the bottom in an axially slidable manner, to which the pressurized fuel is guided from the guide part, a shock-absorbing member having a low spring constant that is predetermined and mitigating an axial impact between the guide part and the pressurizing part, and a sealing member having a high spring constant higher than the low spring constant of the shock-absorbing member, and the sealing member radially sealing a space between the guide part and the pressurizing part, the guide part and the pressurizing part define a gap, and the sealing member is located in the gap, performs a sealing function to the pressurized fuel that enters the gap, and presses the pressurizing part toward the bottom.

2. The fuel supply device according to claim 1, wherein the pressurizing part is inserted in the guide part on an inner peripheral side, and the pressurizing part is provided with a shoulder surface stopping the seal member between the pressurizing part and the guide part from the side of the bottom in the axial direction.

3. The fuel supply device according to claim 2, wherein the pressurizing part is provided with a supporting surface continuing to the side of the bottom in the axial direction from the shoulder surface, and the guide part is slidably supported from an inner peripheral side on the supporting surface.

4. The fuel supply device according to claim 3, wherein the guide part stops the shock-absorbing member on an outer peripheral side of the supporting surface.

5. The fuel supply device according to claim 1, wherein the shock-absorbing member is disposed outside the guide part and outside the pressurizing part.

6. The fuel supply device according to claim 1, wherein the connection structure further has an engaging window part provided to one of the jet pump and the pump unit, and an engaging claw part provided to the other one of the jet pump and the pump unit and engaging with the engaging window part in an axially slidable manner by snap-fitting.

7. The fuel supply device according to claim 1, wherein the pump unit is elastically supported on a top part of the sub-tank from the side of the bottom.

* * * * *